US005439142A

United States Patent [19]

Robertson et al.

[11] Patent Number: 5,439,142

[45] Date of Patent: Aug. 8, 1995

[54] TILTING SERVING DEVICE

[76] Inventors: John M. Robertson, 8805 Charring Cross Rd., Louisville, Ky. 40222; Norma Sydnor, 107 Gardner La., Louisville, Ky. 40205

[21] Appl. No.: 160,779

[22] Filed: Dec. 3, 1993

[51] Int. Cl.[6] ..... B65D 83/00

[52] U.S. Cl. ..... 222/164; 222/166

[58] Field of Search ..... 222/164, 166, 571

[56] References Cited

U.S. PATENT DOCUMENTS

| | | | |
|---|---|---|---|
| 267,191 | 11/1882 | Gough | 222/166 |
| 428,013 | 5/1890 | Mare | 222/166 |
| 592,781 | 11/1897 | Hertwig | 222/166 X |
| 722,025 | 3/1903 | Kroehler | 222/166 |
| 1,878,348 | 9/1932 | Teselle | 222/166 |
| 1,887,881 | 11/1932 | Blattner | 222/166 |
| 1,914,598 | 6/1933 | Feig | 222/571 X |
| 3,155,284 | 11/1964 | Forman et al. | 222/166 X |
| 3,478,931 | 11/1969 | Lynn | 222/166 |

FOREIGN PATENT DOCUMENTS

| | | | |
|---|---|---|---|
| 1083078 | 1/1955 | France | 222/571 |
| 511670 | 11/1930 | Germany | 222/571 |
| 603488 | 10/1934 | Germany | 222/571 |
| 87292 | 7/1936 | Sweden | 222/571 |
| 203669 | 6/1939 | Switzerland | 222/571 |
| 375117 | 6/1932 | United Kingdom | 222/571 |
| 476028 | 11/1937 | United Kingdom | 222/571 |
| 518443 | 2/1940 | United Kingdom | 222/571 |

*Primary Examiner*—Andres Kashnikow
*Assistant Examiner*—Lisa A. Douglas
*Attorney, Agent, or Firm*—Maurice L. Miller, Jr.

[57] ABSTRACT

A tiltable serving device for storing and dispensing a pourable liquid foodstuff such as a gravy, juice, punch or sauce is disclosed. The device includes a container having an upper open end and a pour spout attached to an upper end portion thereof for guiding the flow of a liquid as it is poured from the container. An end portion of the pour spout contains a cornerless hole therethrough which is sized so that a majority portion of a liquid being poured from the container along the pour spout flows over an end of the spout while a minority portion of the liquid flowing along the spout flows through the hole. The hole has an opening on an upper surface of the spout which lies generally parallel to the direction of flow of the liquid flowing along the spout. The pour spout may be in the form of a lip attached to an upper rim portion of the container which extends outwardly and downwardly from the rim. The container may be removably disposed upon a stand whereon it can be tilted to pour a liquid therefrom along the spout.

14 Claims, 2 Drawing Sheets

TILTING SERVING DEVICE

BACKGROUND OF THE INVENTION

The present invention relates in general to apparatus for serving potable liquids and relates in particular to apparatus for serving fluids such as liquids or pourable solids in large volume as well as small volume such as punch or gravy respectively.

Prior art devices are known for serving liquids but in general such devices have required the use of a transfer device such as a spoon or ladle.

In general the use of a transfer device is cumbersome at best and in some cases can be extremely awkward. For example the use of a spoon or ladle to transfer gravy is awkward at best at a dining table but is greatly complicated in a buffet line. Likewise, pouring liquid from a pitcher at a dining table is difficult but to accomplish the same objective in a buffet line without spilling the liquid is far more difficult.

Additionally, when pouring light viscosity liquid from a pour spout prior art devices have experienced a problem where the liquid runs down the outer surface of the spout and the side of the container.

No prior art device is known to accomplish the objectives of arrangements within the scope of the present invention by the means used by devices within the scope of the present invention.

SUMMARY OF THE INVENTION

The present invention provides new and useful arrangements for the delivery of fluids such as liquids or pourable solids from a container to a receptacle.

Because of the unique configuration of devices within the scope of the present invention, manufacturing cost is significantly reduced and operation of the units is greatly facilitated.

More particularly, devices within the scope of the present invention allow the container to be easily removed from the mounting for refill at a remote location and then allow equally easy replacement of the container in the journal of the holder.

Devices within the scope of the present invention allow the base member which provides the journal for the container to be uniquely designed for enhanced appearance and to make the units more attractive.

Further, because of the pivot and journal arrangements provided by devices within the scope of the present invention, pouring lips can be provided on either side of the top of the container which extend outwardly from the container to facilitate pouring liquid from the container without the liquid running down the side of the container.

Additionally, in accordance with one feature of the present invention it has been found that by locating a hole in the pour spout light viscosity liquid poured from the container does not pour down the side of the container as with prior art arrangements.

Briefly, the present invention provides serving arrangements for delivering fluids including liquids or pourable solids from a container having an open top with pivots extending outwardly from opposite sides of the container in generally aligned relation so that a tilt axis is defined through the container. The pivots are received in open top journals to facilitate the placement and removal of the container from the journals and to allow the container to be pivoted in the journals to facilitate serving liquid from the container.

The container can have a pour lip on at least one side of the top to direct liquid poured from the container to a receptacle.

Additionally, arrangements within the scope of the present invention can have a hole through the pour lip adjacent the end so that liquid poured from the container flows through the hole while the bulk of the liquid flows out the pour lip to prevent liquid from running down the side of the container.

Arrangements within the scope of the present invention are adaptable to be used on decorative and ornamental configurations.

Examples of arrangements within the scope of the present invention are shown in the accompanying drawings and described hereinafter but it will be recognized that neither the illustration of examples of devices within the scope of the present invention nor the description thereof are by way of limitation and that other arrangements also within the scope of the present invention will occur to those skilled in the art upon reading the disclosure set forth hereinafter.

BRIEF DESCRIPTION OF THE DRAWINGS

Referring now to the accompanying drawings which illustrate examples of arrangements within the scope of the present invention wherein.

DETAILED DESCRIPTION OF THE DRAWINGS

Figure 1:
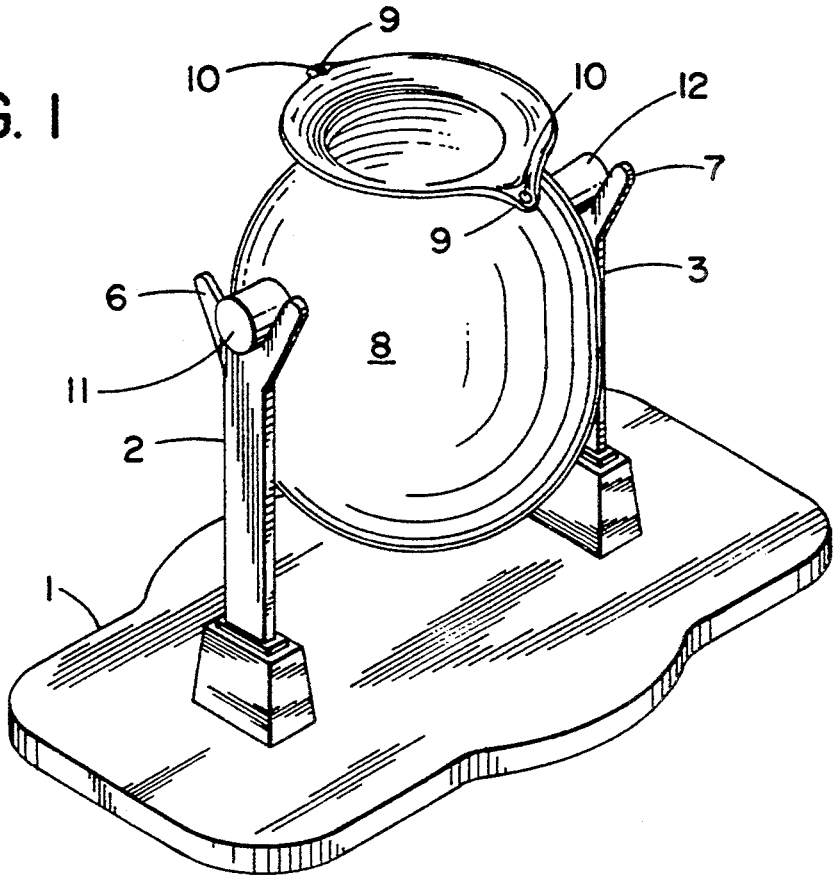
FIG. 1 illustrates one example of an arrangement within the scope of the present invention.

FIG. 1 is a perspective view of one example of an arrangement within the scope of the present invention illustrating a pouring device having a base 1 with upstanding arms 2 and 3. The arms 2 and 3 each terminate in open top journals 6 and 7 respectively.

A container 8 is provided having an open top where pouring spouts 9 are provided on opposite sides of the container. The pouring spouts advantageously extend outwardly of the top of the container so that when the container is tipped as described hereinafter sufficient clearance is provided so a receptacle (not shown) can be positioned with respect to the container so that liquid can be poured from the container into the receptacle without pouring liquid on the side of the container.

In accordance with the present invention a hole 10 is provided in the spout 9. It has been found that by sizing the hole 10 so a majority of the liquid flows out the spout 9 and a portion flows through the hole 10 a situation is provided where liquid does not flow down the side of the container 8 as with prior art devices. The use of the hole 10 to prevent unwanted flow of liquid down the side of the container 8 is particularly important in arrangements of the type contemplated by the present invention where the container 8 is not picked up by the user.

Figure 2:
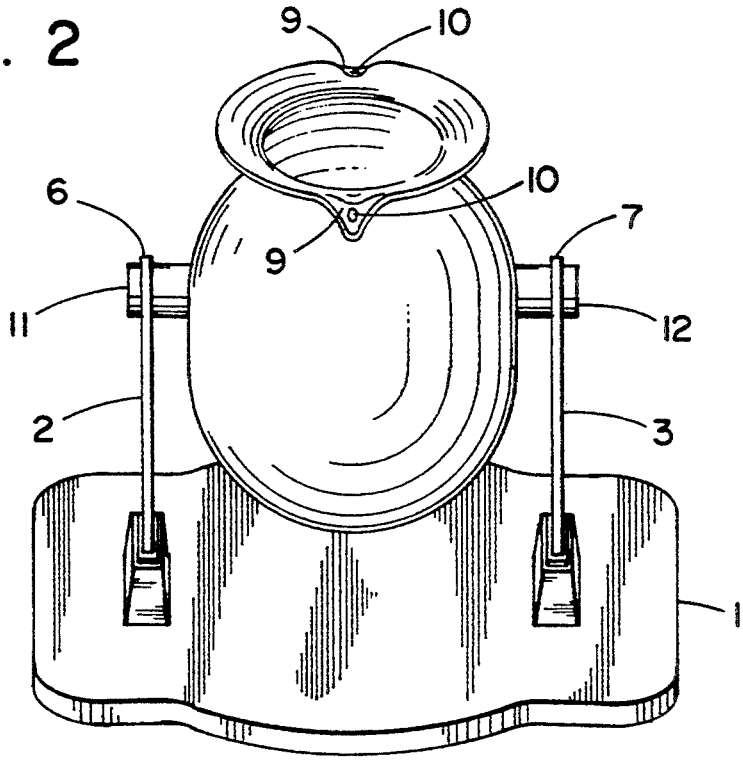
FIG. 2 is another view of the arrangement shown in FIG. 1.

As shown in FIGS. 1 and 2, pivots 11 and 12 are provided in aligned relation on opposite sides of container 8 and adapted to be received in the journals 6 and 7 to allow the container 8 to be pivoted in the journals so that liquid is poured out of the container.

Figure 3:
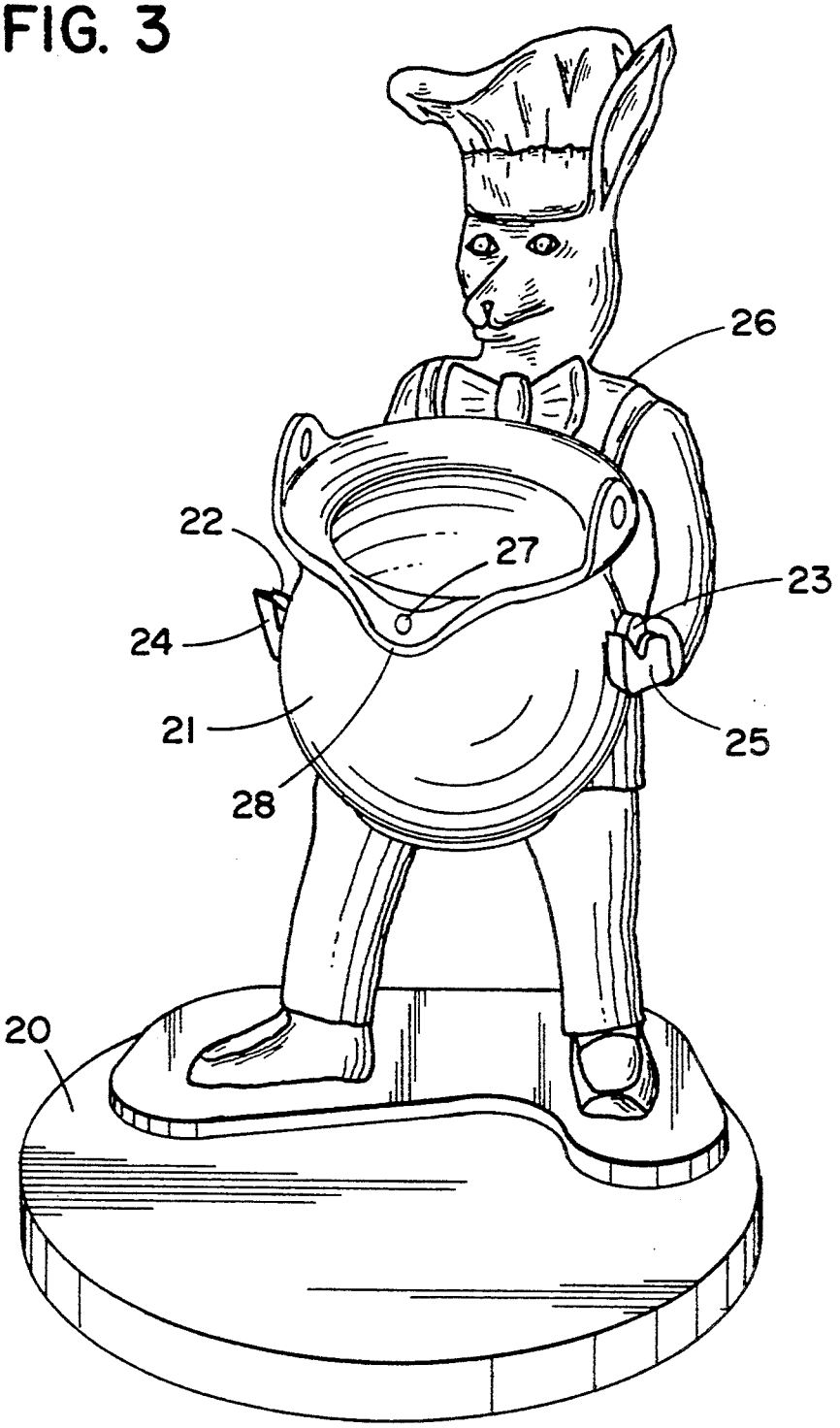
FIG. 3 illustrates another example of an arrangement within the scope of the present invention.

FIG. 3 is a perspective view of yet another arrangement within the scope of the present invention similar to the illustration of FIGS. 1 and 2 except that pivots 22 and 23 of the container 21 are held in journals 24 and 25 which both extend from a common vertical support, which in this case is an animal 26.

As with the previously described example of FIGS. 1–2, the container 21 has a pouring spout 28 with a hole 27 as previously described. The decorative animal 26 is attached to a base 20.

It will be understood that the foregoing are but a few examples of arrangements within the scope of the present invention and that other arrangements also within the scope of the present invention will occur to those skilled in the art upon reading the disclosure set forth hereinbefore.

The invention claimed is:

1. A tiltable serving device for storing and dispensing a liquid comprising a container for storing a liquid therein and for dispensing said liquid therefrom, said container having an open, upper end, a pour spout attached to an upper end portion of said container for guiding the flow of said liquid as said liquid is poured from said container, an end portion of said pour spout defining a cornerless hole therethrough which has an opening on an upper surface of said pour spout which lies parallel to a flow path of said liquid along said pour spout, said hole being sized so that a majority portion of the liquid being poured from said container along said pour spout flows over an end of said pour spout while a minority portion of said liquid flows through said hole, and means for tilting said container for pouring said liquid from said container along said pour spout.

2. The serving device of claim 1 wherein said pour spout comprises a first lip attached to said upper end which extends outwardly and downwardly from said end to direct the flow of said liquid when pouring from said container thereover.

3. The serving device of claim 1 wherein said tilting means comprises a support base, a pair of pivots attached to said container and aligned so as to define a tilt axis through said container, container supporting means attached to and extending upwardly from said base, and a pair of journals attached to said supporting means and disposed in aligned and spaced apart relation for containing said pivots such that said container is suspended between said journals above said base in a normally upright position and such that said container can be tilted on said journals from said upright position for pouring said liquid from said container along said pour spout.

4. The serving device of claim 1 wherein said hole is generally circular in shape.

5. The serving device of claim 2 wherein said lip is integrally attached to said upper end.

6. The serving device of claim 2 further comprising a second lip attached to said open upper end on an opposite side of said container from said first lip, said second lip extending outwardly and downwardly from said end to direct the flow of said liquid when poured from said container thereover.

7. The serving device of claim 3 wherein said container supporting means comprises a pair of spaced apart, vertically upstanding arms, each of said journals being attached to a different one of said arms.

8. The serving device of claim 3 wherein said container supporting means comprises a vertical extending support member attached to said base, and a pair of container supporting arms attached to and extending from said support member, each of said journals being attached to a different one of said supporting arms such that said container fits between said supporting arms and such that said pivots rest in said journals.

9. The serving device of claim 3 wherein said container is removably disposed in said supporting means.

10. The serving device of claim 3 wherein each of said journals comprises a base upon which one of said pivots can be rotatably supported and confined, each of said journals having an open top for removably receiving one of said pivots such that said container can be removably suspended from said journals.

11. A tiltable serving device for storing and dispensing a liquid foodstuff, including gravy, sauce and punch, comprising a container for storing and dispensing a liquid, said container including an open upper end defining a rim, and a pair of pivots attached to opposite external surfaces of said container and aligned so as to define a tilt axis through said container, said device further comprising a first pour spout in the form of a lip attached to said rim and extending outwardly and downwardly therefrom, an end portion of said lip defining a cornerless hole therethrough which is sized such that, when a liquid is poured from said container over said rim and along said lip, a majority portion of the liquid flowing along said lip flows off the end of said lip and a minority portion of said flowing liquid flows through said hole, said hole having an opening on an outwardly facing surface of said lip relative to said container which lies parallel to a flow path of said liquid along said lip, a container support base, container supporting means attached to and extending upwardly from said base, and a pair of journals spaced above said base, said journals being attached to said supporting means and arranged in aligned and spaced apart relation for containing said pivots such that said container is suspended above said base by said journals in a normally upright position and such that said container can be tilted on said journals from said upright position for pouring a liquid from said container over and along said lip.

12. The serving device of claim 11 wherein said journals are adapted for removable disposition of said pivots therein whereby said container can be removably suspended in said supporting means.

13. The serving device of claim 11 wherein said hole is generally circular in shape.

14. The serving device of claim 11 wherein said container further comprises a second pour spout identical to said first pour spout, said first and said second pour spout being located on opposite sides of said rim such that said container can be tilted in one direction to pour a liquid from said container along said first spout and can be tilted in an opposite direction to pour said liquid from said container along said second spout.

* * * * *